US006745481B1

(12) United States Patent
Faircloth

(10) Patent No.: US 6,745,481 B1
(45) Date of Patent: Jun. 8, 2004

(54) HOSIERY INSPECTION DEVICE AND METHOD

(75) Inventor: Michael Faircloth, Winston-Salem, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/102,581

(22) Filed: Mar. 20, 2002

(51) Int. Cl.[7] ..... A41H 1/00

(52) U.S. Cl. ..... 33/2 A; 33/3 R; 33/4; 33/3 B; 33/3 C; 33/11; 33/8; 33/2 R

(58) Field of Search ..... 33/2 A, 2 R, 3 R, 33/4, 3 B, 3 C, 11, 8

(56) References Cited

U.S. PATENT DOCUMENTS

| | | | | |
|---|---|---|---|---|
| 2,558,846 A | * | 7/1951 | Guild et al. | 33/2 R |
| 2,712,755 A | * | 7/1955 | Meytre | 33/2 R |
| 2,794,340 A | * | 6/1957 | Cobert | 33/2 A |
| 3,639,987 A | * | 2/1972 | Page | 33/2 A |
| 3,639,988 A | * | 2/1972 | Impastato | 33/11 |
| 3,730,405 A | * | 5/1973 | Ezell et al. | 223/72 |
| 3,750,291 A | * | 8/1973 | Foreman | 33/2 A |
| 3,879,990 A | | 4/1975 | Joy | |
| 4,136,557 A | * | 1/1979 | Bell et al. | 33/2 A |
| 5,094,110 A | | 3/1992 | Porter et al. | |

FOREIGN PATENT DOCUMENTS

| | | |
|---|---|---|
| EP | 0538588 A1 | 4/1993 |
| GB | 2104564 A | 3/1983 |
| GB | 2179741 A | 3/1987 |

OTHER PUBLICATIONS

UK Patent Application, GB 2 081 321, Ambrogini et al., Jul. 11, 1980.*

* cited by examiner

*Primary Examiner*—Diego Gutierrez
*Assistant Examiner*—Amanda J Hoolahan
(74) *Attorney, Agent, or Firm*—Kilpatrick Stockton LLP

(57) ABSTRACT

A pantyhose inspection device comprises a flat panel having two spaced-apart legs extending upwardly from a bifurcation point, a transverse bar positioned between the two legs, a vertical center bar having a plurality of center seam measurement indicators, a vertical, rectangular-shaped cutout on each side of the center bar, a plurality of panty volume indicators, toe length indicators, a waistband attachment mechanism, and a waistband stretch measurement scale. Such a device allows quick and reliable assessment of gusset placement, center seam straightness and stretch, panty volume, toe length, and waistband stretch in a pantyhose garment using a single device.

61 Claims, 5 Drawing Sheets

HOSIERY INSPECTION DEVICE AND METHOD

FIELD OF THE INVENTION

The present invention relates to pantyhose manufacture, and in particular to a device and method for inspecting pantyhose garments. Embodiments of the present invention are advantageous for efficient, in-line inspection of pantyhose garments for quality control purposes.

BACKGROUND OF THE INVENTION

Quality control is an important aspect of successful pantyhose manufacturing operations. Pantyhose quality control inspections typically include assessment of alignment and stretch characteristics relative to pre-determined manufacturing specifications. For example, pantyhose quality control inspections often include assessment of gusset alignment, panty, or center seam, alignment and stretch, panty volume, toe length (toe seam position), and/or waistband stretch. Conventional pantyhose quality control inspection systems involve the use of multiple pieces of large, expensive equipment. The equipment can be placed at inspection stations in the manufacturing production line. However, due to space and time constraints in manufacturing processes, pantyhose quality control inspection is often performed at the conclusion of the manufacturing process at one or more inspection stations separate from the production line. Inspection at the end of the manufacturing process typically involves the use of several different pieces of inspection equipment, with each piece of equipment being used to inspect a different quality parameter. Thus, typical post-production inspections have the disadvantage of being inefficient and costly, in terms of both the equipment and labor required.

A disadvantage of conventional inspection devices and processes is that they do not include a means for inspecting the stretch of a panty center seam a means for inspecting the stretch of a waistband. Additionally, conventional inspection devices and processes do not include means for quantitatively measuring the degree of stretch and volume in a sample pantyhose garment. Another disadvantage is that conventional pantyhose inspection equipment and processes do not include the capability for inspecting multiple manufacturing parameters in a single device that can be efficiently and effectively utilized in a production line.

Yet another disadvantage of conventional pantyhose inspection equipment and processes relates to assessing gusset placement. When a pantyhose garment is manually inspected using conventional inspection panels, the pantyhose garment is placed over leg portions extending from the panel. In conventional inspection panels, the legs extend out straight along the longitudinal axis of the panel. The torque exerted on a pantyhose garment when placed over the legs on conventional inspection panels often causes the gusset to twist. Twisting causes the gusset to be misaligned and may result in an inaccurate assessment of gusset alignment relative is to comparison structures on the panel. Moreover, efforts to properly align a gusset on the panel may require moving to the opposite side of the panel to observe the opposite side of the gusset. Such alignment verification and realignment steps create inefficiencies and possible inaccuracies in the evaluation of gusset alignment.

Thus, there is a need for a pantyhose inspection device and method that allows for the inspection of multiple quality control parameters, including gusset alignment, panty center seam alignment and stretch, panty volume, defined toe length, and waistband stretch, in a single device. There is a need for a such pantyhose quality control inspection device that is simple and efficient to use. There is a need for an inspection device and method that allows for quantitative measurement of the degree of stretch and other parameters in a sample pantyhose garment. There is a need for a simple, efficient pantyhose quality control inspection device that avoids the need for large, complex, and expensive measurement equipment and that can be used for inspection in a production line. There is also a need for a such a pantyhose inspection device that can be easily moved from one inspection station to another.

SUMMARY OF THE INVENTION

The present invention provides hosiery inspection devices and methods that are advantageous for efficient, production-line inspection of pantyhose garments for quality control purposes.

An embodiment of a pantyhose inspection device of the present invention comprises a substantially flat panel having a top, a bottom, a front, a back, and two sides, the panel being symmetrical about a central vertical axis between the two sides. Two legs extend upwardly from the top of the panel and are spaced apart beginning at a bifurcation point. A transverse bar is positioned between the two legs, and the spaced-apart legs and transverse bar define a triangular crotch area. A center bar extends vertically downward from the bifurcation point along the central vertical axis to the bottom of the panel. The center bar has a plurality of center seam measurement indicators in the vertical direction. The panel includes a rectangular-shaped cut-out on each side of the center bar in the vertical direction. When a pantyhose garment having a gusset and a center seam is placed over the legs, the transverse bar, and the panel, the gusset is viewable about and through the triangular crotch area below the transverse bar for assessing gusset alignment The center seam is viewable for inspection of alignment with the center bar and for center seam stretch of the pantyhose garment in relation to the center bar measurement indicators.

In embodiments, a pantyhose inspection device of the present invention includes a plurality of panty volume indicators spaced apart along pre-determined zones of panty volume expansion. When the pantyhose garment is stretched downwardly over the panel, a panty volume of the pantyhose garment can be assessed in relation to the zones of panty volume expansion.

In a pantyhose inspection device of the present invention, the legs can include spaced-apart toe length indicators defining a predetermined range for acceptable pantyhose toe length, as measured, for example, by toe seam position. When a leg of the pantyhose garment having a toe seam is placed over a leg of the panel, the position of the pantyhose garment toe seam, and the length of the toe portion, can be inspected in relation to the toe length indicators.

Other embodiments include a pantyhose waistband attachment mechanism for releasably attaching a pantyhose waistband and a waistband stretch measurement scale. When a pantyhose waistband is attached to the attachment mechanism and stretched along the waistband stretch scale, a measurement of the amount of waistband stretch of the pantyhose can be quickly determined.

In embodiments of the present invention, the upwardly extending legs taper distally from the bifurcation point and angle towards the central vertical axis of the panel to facilitate ergonomic placement of a pantyhose garment onto the inspection device. Preferably, the front and the back of the inspection device panel are identical so that inspection of a pantyhose garment can be performed while viewing either the front or the back of the device.

A pantyhose inspection device of the present invention can include a base which can be rotatably attached to the panel. The base can comprise a means, such as caster or wheels, for moving the base and the panel. In embodiments, the panel comprises a rigid material, such as aluminum or plastic, and can be covered with a non-stick coating.

Embodiments of the present invention include methods for inspecting a pantyhose garment comprises inspecting alignment of the gusset, inspecting alignment of the center seam, determining a measurement of center seam stretch, inspecting the panty volume, inspecting a position of the toe seam, and determining a measurement of waistband stretch. In this method, each of these steps is performed using a single inspection device in a manufacturing production line.

Features of a hosiery inspection device and method of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A pantyhose inspection device and method of the present invention provides for quick and efficient inspection of multiple manufacturing parameters for pantyhose garments during the manufacturing process and/or after manufacture is complete. For example, a pantyhose inspection device and method of the present invention advantageously provides for quick inspection of gusset alignment and center seam alignment and stretch. Embodiments allow for quick qualitative inspection of panty volume. Other embodiments provide for quick inspection of toe seam position. Other embodiments allow for quick measurement of waistband stretch. Another advantage is that embodiments of the present invention incorporate each of these inspection capabilities into a single inspection device and method.

Another advantage is that embodiments of the present invention provide ergonomically angled and tapered leg portions similar to proper anatomical alignment that facilitate ease of placing and removing a pantyhose garment on such an inspection device. Anatomically similar inspection devices of the present invention beneficially reduce gusset twisting upon application of a pantyhose garment on the device, allowing gusset alignment to be accurately assessed.

Another advantage is that the present invention provides hosiery inspection devices that are identical on each side of the device such that an operator can quickly, and reliably, assess front-to-back and side-to-side gusset alignment without turning the device around.

Still another advantage is that the present invention provides hosiery inspection devices that are simple and easy to use. For example, embodiments of hosiery inspection devices include a mobile and rotatable base to facilitate ease of use and movement between inspection stations.

Still another advantage is that hosiery inspection devices of the present invention are simple and inexpensive to make, and may be made from a variety of materials. Such embodiments avoid the need for large, heavy, and expensive inspection equipment to be used in a manufacturing line. This feature is particularly advantageous in situations and locations where sophisticated testing equipment may not be available or would not fit into a manufacturing line.

Yet another advantage is that the present invention provides for quick inspection of multiple manufacturing parameters in a reliable manner. Use of several conventional single-test inspection devices permit in-line quality control inspections of a limited number of samples in each batch of hosiery due to the time required for applying hosiery garments to and removing them from multiple devices. Hosiery inspection devices and methods of the present invention allow inspection of significantly greater numbers of samples in each batch, effectively providing a more reliable pantyhose manufacturing quality control program.

As will be realized by those of skill in the art, many different embodiments of a hosiery inspection device and method according to the present invention are possible. Additional uses, objects, advantages, and novel features of the invention are set forth in the detailed description that follows and will become more apparent to those skilled in the art upon examination of the following, or by practice of the invention.

DETAILED DESCRIPTION OF THE INVENTION

Figure 1:
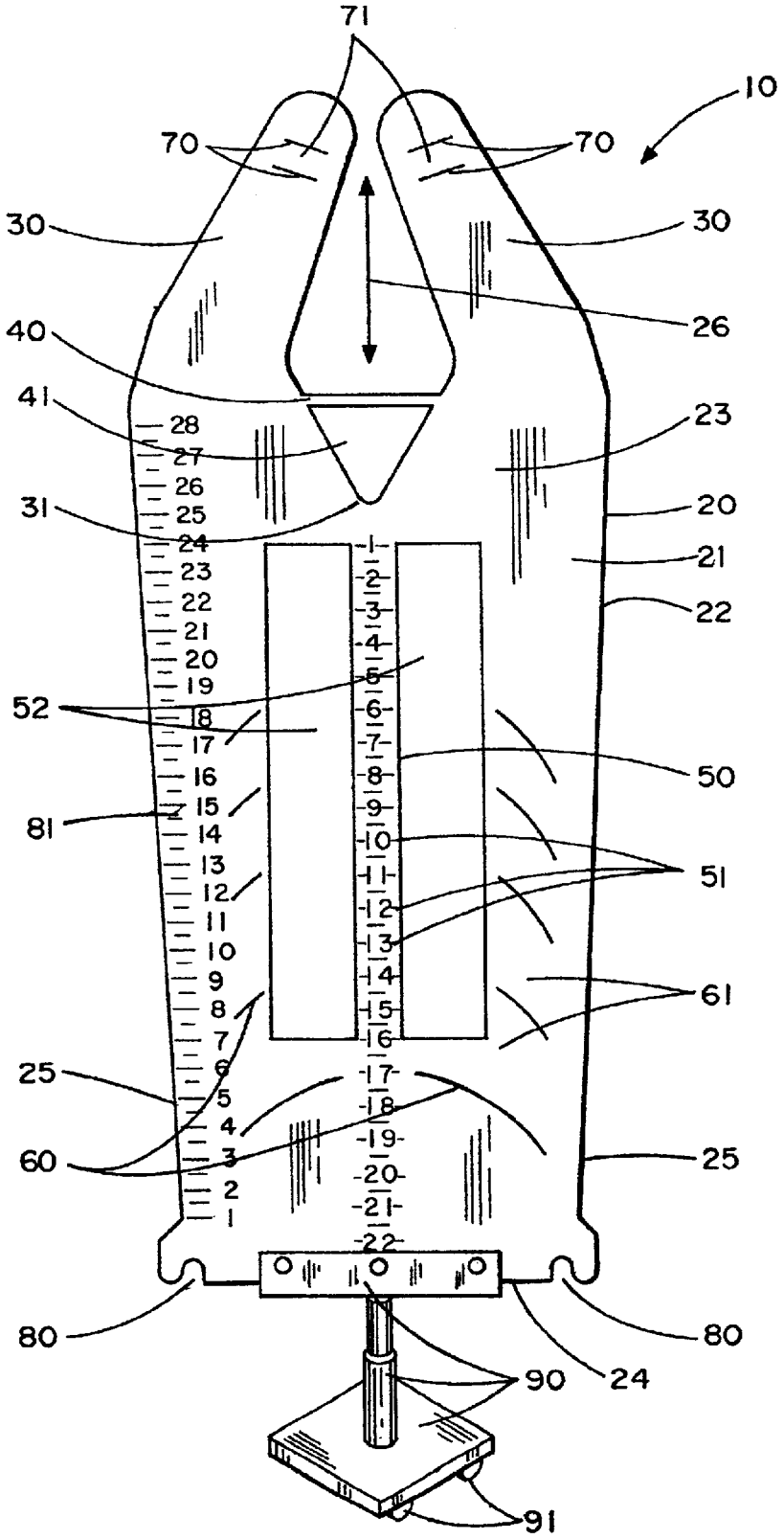
FIG. 1 is a view of a pantyhose inspection device in an embodiment of the present invention.

FIGS. 1–5 show various embodiments of a hosiery inspection device and method of the present invention. FIG. 1 shows one such embodiment. In the embodiment shown in FIG. 1, a pantyhose inspection device 10 comprises a substantially flat panel 20 having a front 21, a back 22, a top 23, a bottom 24, and two opposite sides 25. The panel 20 is symmetrical about a central vertical axis 26 between the two sides 25. Two legs 30 extend upwardly from the top 23 of the panel 20 and are spaced apart beginning at a bifurcation point 31. A transverse bar 40 is positioned between the two legs 30 proximate the bifurcation point 31, such that the spaced apart legs 30 and transverse bar 40 define an open triangular crotch area 41. A center bar 50 extends vertically downward from the bifurcation point 31 along the central vertical axis 26 to the bottom 24 of the panel 20. The center bar 50 includes a plurality of center seam measurement indicators 51 in a vertical direction along the center bar 50. A rectangular-shaped cut-out 52 is located on each side of and adjacent to the center bar 50 in the vertical direction.

Figure 2:
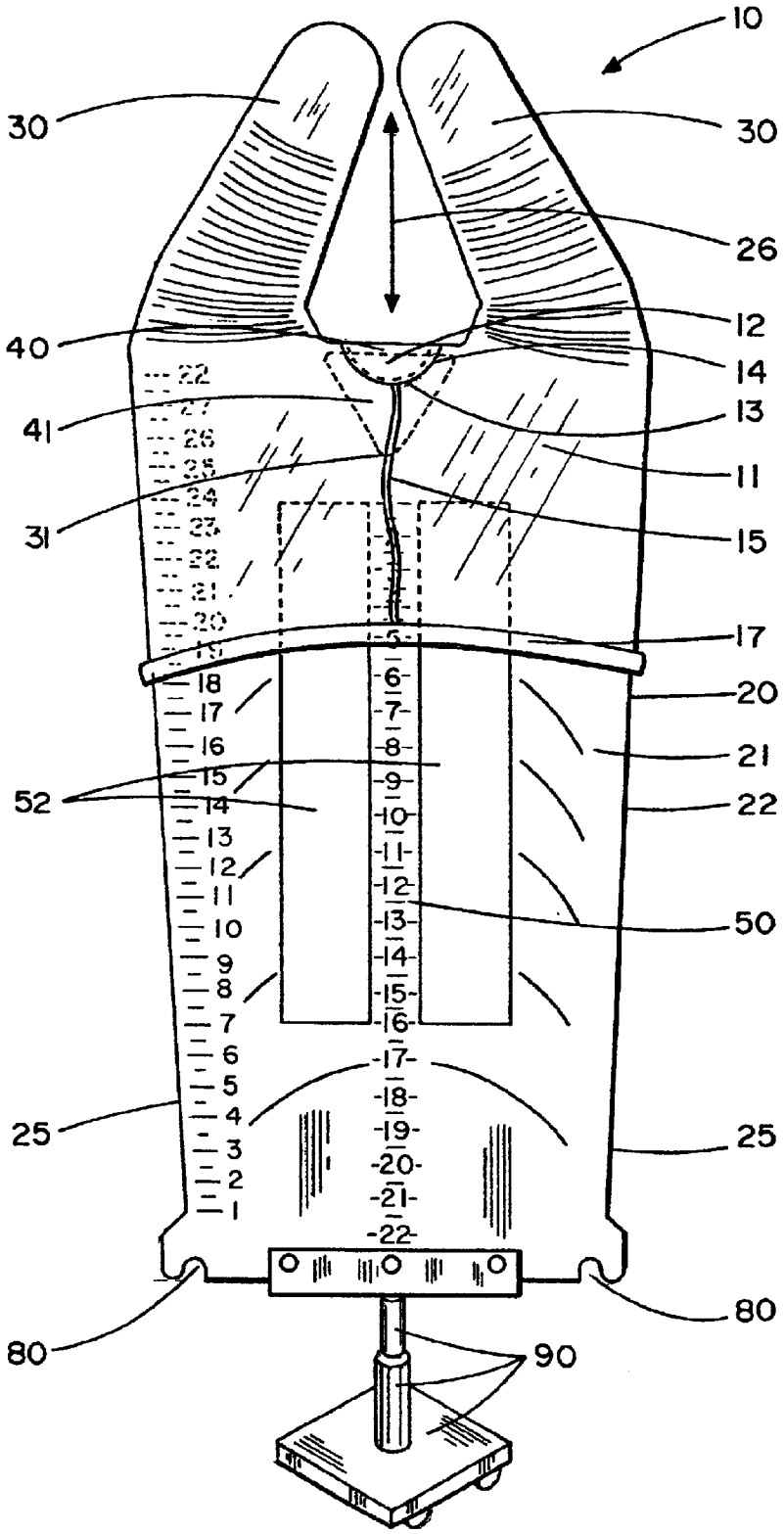
FIG. 2 is a view of a pantyhose inspection device showing a pantyhose garment partially stretched over the device in an embodiment of the present invention.

The pantyhose inspection device 10 allows assessment of gusset placement, panty center seam placement, and stretch of the panty center seam. As shown in FIG. 2, placing a pantyhose garment 11 having a gusset 12 and a center seam 15 downwardly over the legs 30, the transverse bar 40, and the panel 20 allows inspection of the pantyhose garment 11 for such gusset and center seam quality control parameters. With the pantyhose garment 11 in place over the inspection device 10, the gusset 12 is viewable for inspection in the triangular crotch area 41 below the transverse bar 40, allowing for assessment of gusset alignment. The center seam 15 is viewable for inspection of alignment with the center bar 50, and a measure of the stretch of the center seam 15 can be determined in relation to the center bar measurement indicators 51.

Figure 5:
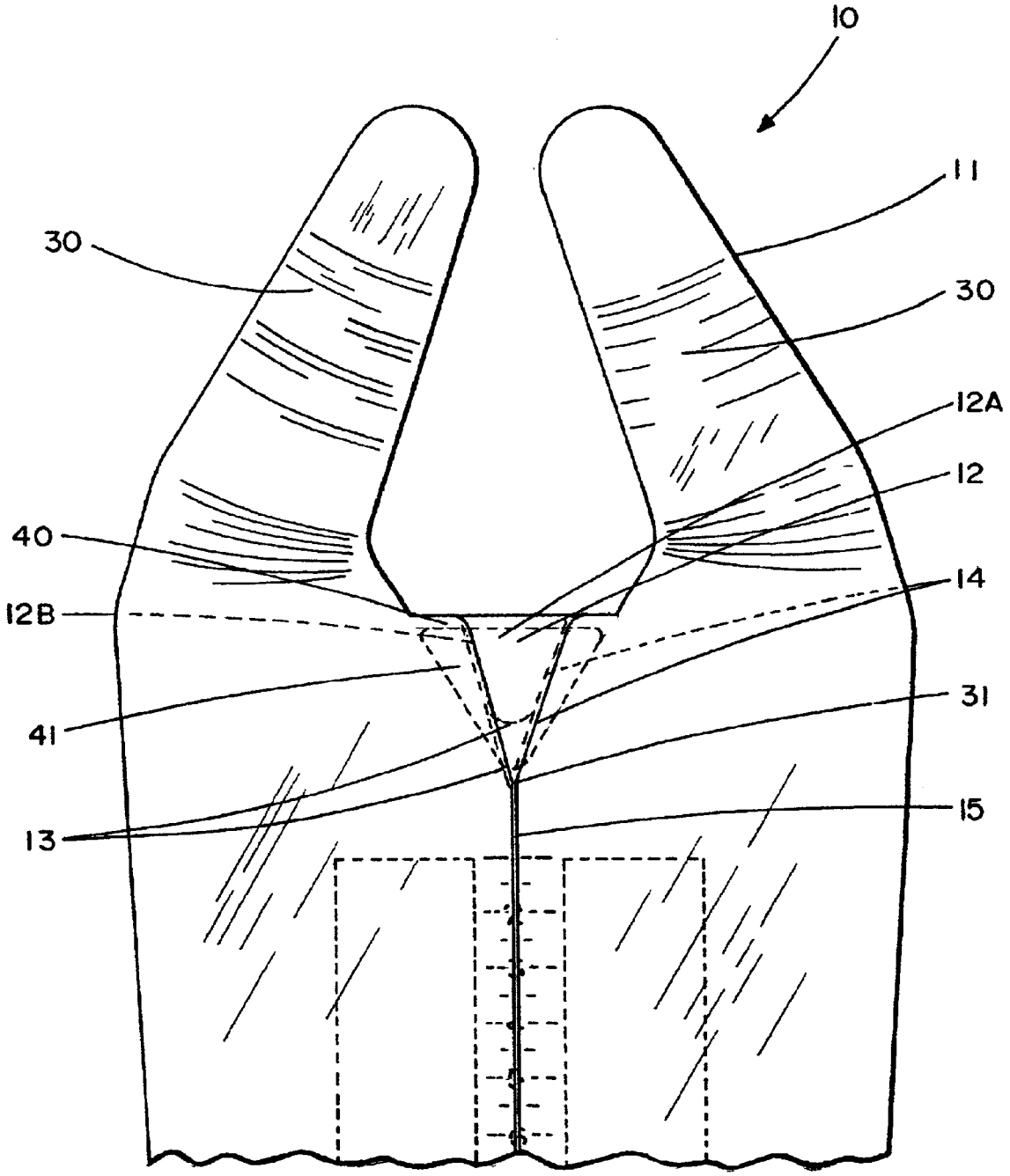
FIG. 5 is a view of a portion of a pantyhose inspection device showing inspection of gusset alignment in a pantyhose garment in an embodiment of the present invention.

Referring to the embodiment in FIG. 5, by pulling the pantyhose garment 11 down over the transverse bar 40 and triangular crotch area 41, a front portion 12A and a back portion 12B of the gusset 12 is positioned for inspection of alignment. With the gusset front portion 12A and back portion 12B positioned over the transverse bar, the degree of alignment along the seam of the medial portions 13 of the gusset 12 is readily seen near the bifurcation point 31 within the triangular crotch area 41. The degree of alignment of the gusset medial portions 13 shows the degree of proper front-to-back gusset alignment. The degree of alignment along the seam of the lateral portions 14 of the gusset 12 is readily seen as a "V-shaped" pattern about the central vertical axis 26 within the triangular crotch area 41. The degree of alignment of the gusset lateral portions 14 shows the degree of proper side-to-side gusset alignment.

Figure 3:
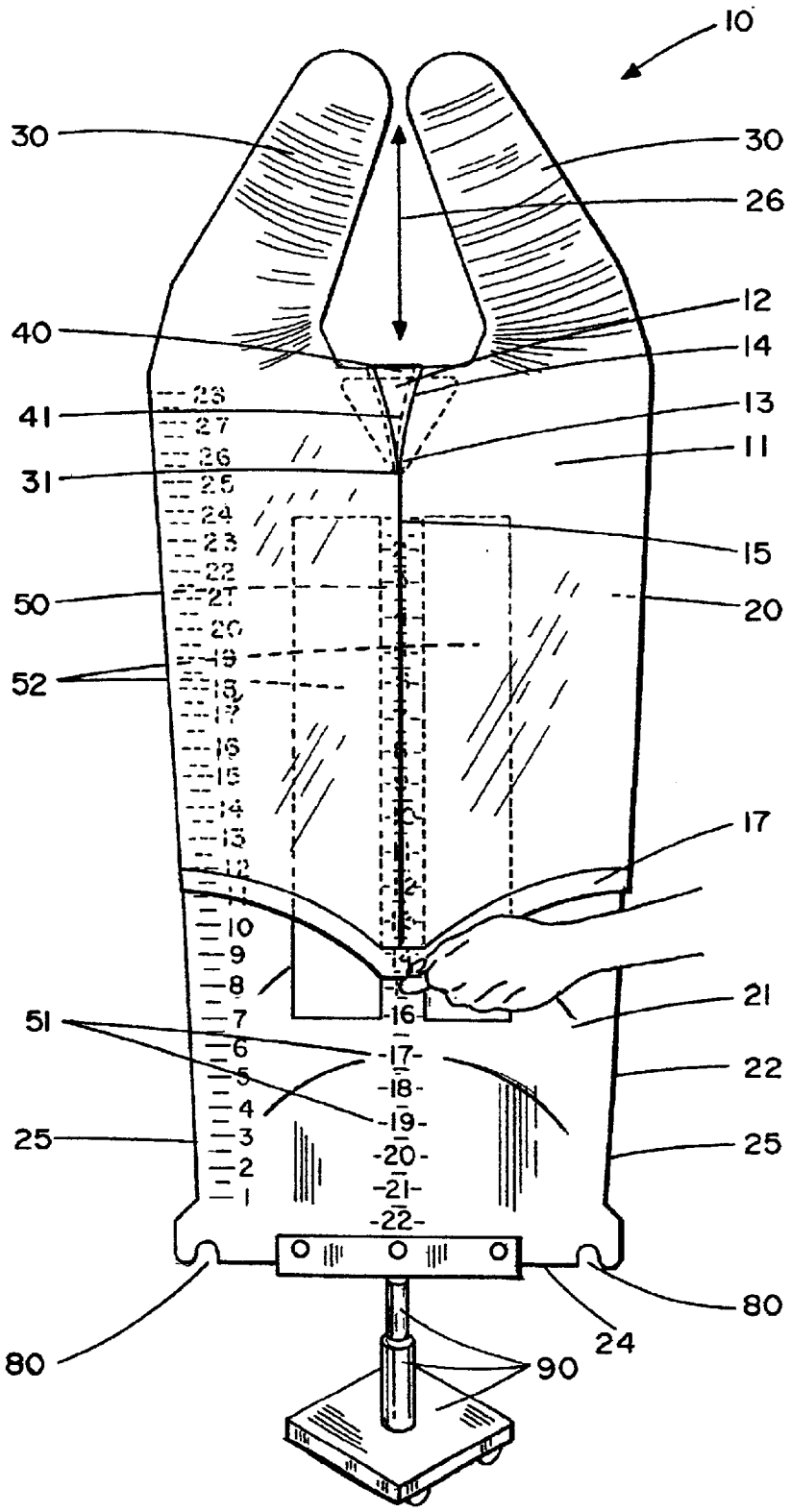
FIG. 3 is a view of a pantyhose inspection device showing inspection of gusset alignment and center seam alignment and stretch in a pantyhose garment in an embodiment of the present invention.

As shown in FIG. 3, an embodiment of the pantyhose inspection device 10 provides for qualitative assessment of the straightness of center seam 15 along center bar 50. The rectangular-shaped cut-out 52, located along and on each side of the center bar 50, allows a user to simultaneously view the center seam 15 along both the front 21 and the back 22 of the panel 20. With the gusset 12 in position over the transverse bar 40, the center seam 15 of the pantyhose garment 11 is stretched by manually pulling downwardly on the waistband 17 along the center bar 50. The axis of the center seam 15 of a properly sewn pantyhose garment should visually align along the central vertical axis 26 of the center bar 50. In addition, the center seam 15 of a properly sewn pantyhose garment along the front 21 of panel 20 should also align with the center seam 15 along the back 22 of the panel 20. By comparing any variance from parallel alignment of the center seam 15 axis with the center bar 50 and any variance from alignment of the center seam 15 along the front 21 and along the back 22 of the panel 20, the quality of center seam straightness can be readily assessed.

In the embodiment of the pantyhose inspection device 10 in FIG. 3, the amount of vertical stretch of the center seam 15 and of the pantyhose garment 11 panty portion can be quantitatively assessed. When the center seam 15 is manually stretched downwardly along the center bar 50 on both the front 21 and the back 22 of the panel 20, the stretch of the center seam 15 can be measured relative to the plurality of center seam measurement indicators 51 along the center bar 50. With the center seam 15 stretched downwardly along the center bar 50, the point to which the waistband 17 stretches along the center seam measurement indicators 51 indicates the amount of stretch of center seam 15. By comparing the measured amount of center seam 15 stretch with pre-determined manufacturing specifications, the quality of center seam 15 stretch can be quickly assessed.

Figure 4:
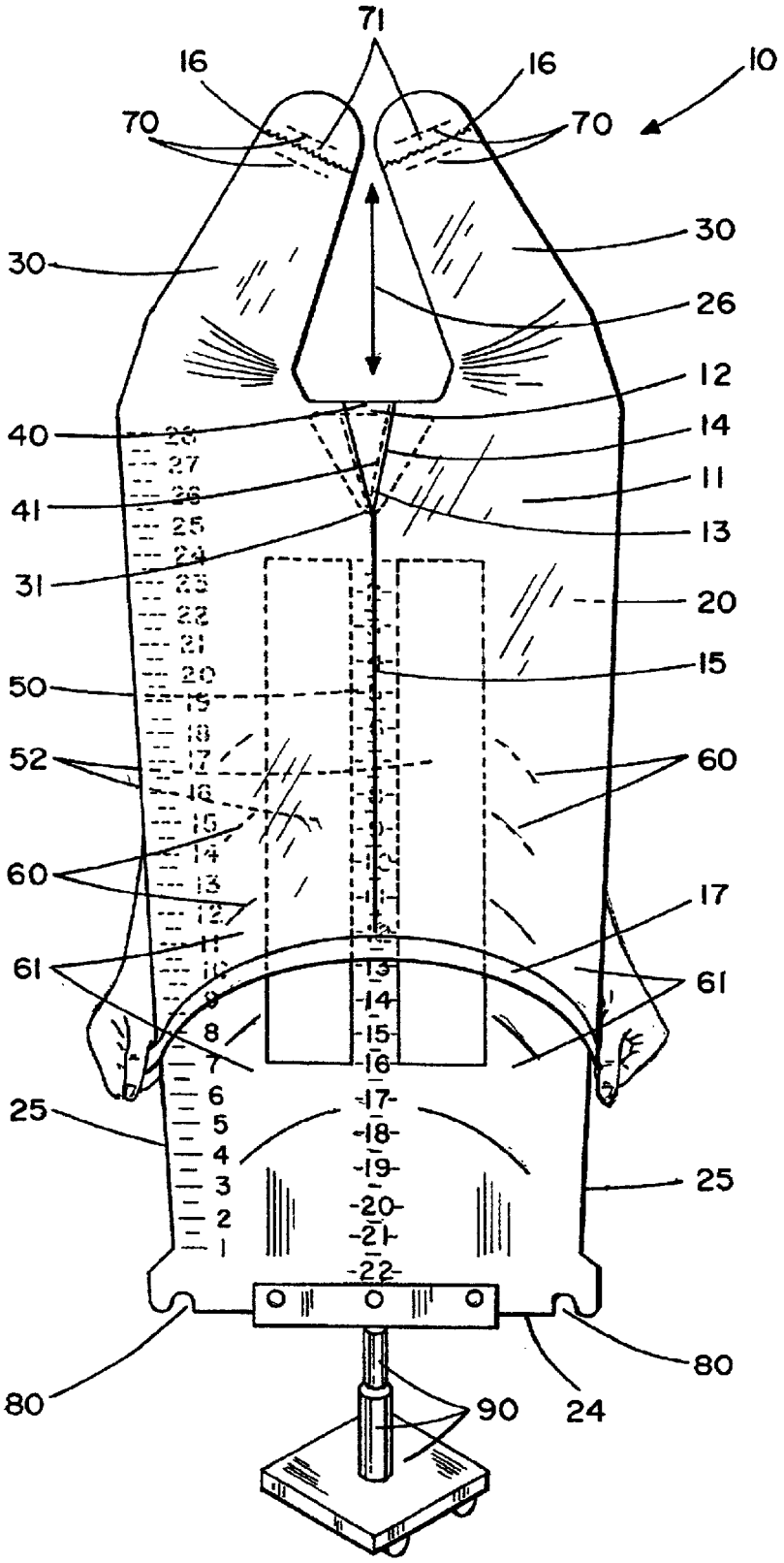
FIG. 4 is a view of a pantyhose inspection device showing inspection of panty volume and toe length of a pantyhose garment in an embodiment of the present invention.

Referring now to FIG. 4, an embodiment of the pantyhose inspection device 10 provides for qualitative assessment of panty volume, as indicated by expandability of the pantyhose garment 11 panty portion, generally between the level of the gusset 12 and the waistband 17. As shown in FIG. 4, a plurality of panty volume indicators 60 are spaced apart along each of the two sides 25 of the panel 20 lateral to the rectangular cut-outs 52. The panty volume indicators 60 demarcate pre-determined zones 61 of panty volume. Each of the plurality of panty volume indicators 60 comprises a downwardly arcuate line. The space within each zone 61 of panty volume expansion between each of the panty volume indicators 60 indicates an acceptable measure of panty expansion for a particular size of pantyhose garment according to pre-determined manufacturing specifications. When the waistband 17 of the pantyhose garment 11 is manually stretched downwardly along each side 25 of the panel 20, the amount of expandability, or volume, of the pantyhose garment 11 panty portion can be quickly assessed. If the waistband 17, when stretched as such, falls within the zone 61 of panty volume for the particular size of the pantyhose garment being inspected, the pantyhose garment meets quality control expectations for panty volume.

Embodiments of the present invention provide for qualitative assessment of toe length, or distance of a toe seam from the end of a pantyhose garment leg, as shown in FIGS. 1 and 4. The legs 30 extending from panel 20 include two spaced-apart toe length indicators 70, which define a pre-determined range 71 for acceptable pantyhose toe length. The range 71 is determined by calibrating toe length position on standardized upright inspection legforms, such as those used by Sara Lee Hosiery. In this embodiment, the two spaced-apart toe length indicators 70 comprise substantially parallel lines. As shown in FIG. 4, when a leg of the pantyhose garment 11 having a toe seam 16 is placed over a leg 30 extending from the panel 20, the position of the pantyhose garment toe seam 16 can be quickly assessed in relation to the two spaced-apart toe length indicators 70 and the range 71 for acceptable pantyhose toe length. If the toe seam 16 stretches to a point within the range 71 between the two toe length indicators 70, the toe length and placement meet quality control parameters for a pre-determined proper toe length.

As shown in FIG. 1, an embodiment of the pantyhose inspection device 10 provides for quantitative assessment of waistband stretch. The flat panel 20 includes a pantyhose waistband attachment mechanism 80 for quickly attaching and removing a pantyhose waistband. The panel 20 includes a waistband stretch measurement scale 81 vertically along the side 25 of the panel 20 beginning at the pantyhose waistband attachment mechanism 80 at the bottom 24 of the panel 20. In the embodiment shown in FIG. 1, the pantyhose waistband attachment mechanism 80 comprises a hook, located at the bottom 24 of the panel 20. In other embodiments, the pantyhose waistband attachment mechanism 80 can comprise other means for releasably attaching a pantyhose garment waistband and could be located along with the waistband stretch measurement scale 81 at other positions on the panel 20. When a pantyhose waistband is attached to the waistband attachment mechanism 80 and stretched upward along the waistband stretch measurement scale 81, the amount of waistband stretch of the pantyhose garment 11 can be determined. The point on the waistband stretch measurement scale 81 to which the waistband stretches is the amount of waistband stretch. The amount of waistband stretch is compared to pre-determined pantyhose waistband stretch manufacturing specifications to assess the quality of stretch in the waistband under inspection.

Embodiments of a pantyhose inspection device of the present invention allow pantyhose garments to be placed onto the inspection device in an ergonomic fashion. As shown in FIGS. 1–5, the upwardly extending legs 30 taper distally from the bifurcation point 31 and angle towards the central vertical axis 26 of the panel 20. As such, legs 30 provide a configuration that allows ease in placing a pantyhose garment over the legs 30. Such configuration of legs 30, bifurcation point 31, and transverse bar 40 is consistent with normal anatomical alignment and thus provides for less twisting and less distortion of a gusset and a center seam due to the effort of placing a pantyhose garment on the inspection device. As a result, quality control assessments can be performed more efficiently and accurately than in conventional devices.

In addition, embodiments of a pantyhose inspection device of the present invention allow direct visual alignment of courses and wales in a pantyhose garment under inspection. The triangular crotch area 41 and the rectangular-shaped cut-outs 52 provide for simultaneous viewing of both sides of a pantyhose garment by an inspector. By visually aligning courses and wales on both sides of a pantyhose garment through the triangular crotch area 41 and the rectangular-shaped cut-outs 52, the accuracy and reliability of quality control inspections is enhanced.

In preferred embodiments of the present invention, both the front 21 and the back 22 of the inspection device 10 are identical so that inspection of pantyhose garments can be performed from either the front 21 or the back 22.

As shown in FIGS. 1–4, embodiments of a pantyhose inspection device 10 comprise a base 90 attached to the panel 20. The base 90 is shown having a square bottom platform, though the base 90 can have any other shape suitable for supporting the pantyhose inspection device 10. For example, the base 10 can be round or triangular. Preferably, the base 90 comprises a configuration and weight sufficient to support the panel 20 and provide stability during use. In preferred embodiments, the panel 20 is rotatably attached to the base 90, so that the inspection device 10 can be rotated from front to back as desired. The base 90 preferably includes a means for moving the base 90 and attached inspection device 10. In the embodiment shown in FIG. 1, the means for moving the base 90 and attached inspection device 10 comprises casters 91 to facilitate easy movement of the pantyhose inspection device 10.

A pantyhose inspection device 10 of the present invention can be constructed from a variety of materials suitable for maintaining a rigid shape. For example, such a pantyhose inspection device 10 can be made from aluminum, plastic, and/or composite materials. In preferred embodiments, a pantyhose inspection device 10 comprises aluminum covered with a non-stick coating.

Embodiments of the present invention comprise a pantyhose inspection device that allows multiple quality control assessments to be made in a single device. The embodiment shown in FIG. 1, for example, includes features that allow qualitative assessment of side-to-side and front-to-back gusset placement, qualitative assessment of panty center seam placement, quantitative assessment of panty center seam stretch, qualitative assessment of panty volume, qualitative assessment of toe seam placement, and quantitative assessment of waistband stretch. Incorporation of such multiple quantitative and qualitative assessment capabilities into a single device improves efficiency and reliability of pantyhose quality control processes and outcomes.

Embodiments of the present invention include a method for inspecting a pantyhose garment having a gusset, a center seam, a panty volume, a defined toe length and toe seam, and a waistband at a single station in a manufacturing production line, comprising the steps of inspecting alignment of the gusset; inspecting alignment of the center seam; determining a measurement of center seam stretch; inspecting the panty volume; inspecting a position of the toe seam; and determining a measurement of waistband stretch.

In other embodiments, a method for inspecting a pantyhose garment in a manufacturing production line comprises providing a pantyhose inspection device 10, as shown in FIG. 1, comprising a substantially flat panel 20 having a central vertical axis 26, two spaced-apart legs 30, and a transverse bar 40 positioned between the two legs 30, the spaced apart legs 30 and transverse bar 40 defining a triangular crotch area 41, a center bar 50 extending vertically downward along the central vertical axis 26, and a plurality of center seam measurement indicators 51 along the center bar 50.

As shown in FIGS. 4 and 5, the method includes stretching a pantyhose garment 11 having a gusset 12, a center seam 15, a panty volume, a toe seam 16, and a waistband 17 over the legs 30, the transverse bar 40, and the panel 20. Once the pantyhose garment 11 is in place, front-to-back alignment and side-to-side alignment of the gusset 12 is inspected through the triangular crotch area 41. The method further includes inspecting alignment of the center seam 15 in relation to the center bar 50. A measurement of center seam stretch is determined in relation to the plurality of center seam measurement indicators 51, and the center seam stretch measurement is compared with pre-determined manufacturing parameters.

In other embodiments of a method of the present invention, the inspection panel further comprises a plurality of panty volume indicators 60 spaced apart along pre-determined zones 61 of panty volume expansion, and each of the two sides 25 of the panel 20 further comprises an edge. Such an embodiment includes stretching the pantyhose garment waistband 17 downwardly along each edge, and inspecting panty volume by comparing the location of the stretched waistband 17 in relation to the pre-determined zones 61 of panty volume expansion.

In other embodiments of a method, each of the two legs 30 further comprise two spaced-apart toe length indicators 70 defining a pre-determined range 71 for acceptable pantyhose toe length and position. Such an embodiment includes stretching a pantyhose garment 11 having a toe seam 16 over a leg 30 extending from the panel 20, and comparing the position of the pantyhose garment toe seam 16 and toe length in relation to the two spaced-apart toe length indicators 70.

In other embodiments of a method, each of the two sides 25 of the panel 20 further comprise an edge and the panel 20 further comprises a pantyhose waistband attachment mechanism 80 located proximate at least one of the edges for releasably attaching a pantyhose waistband 17 and a waistband measurement scale 81 along at least one of the edges proximate the pantyhose waistband attachment mechanism 80. Such an embodiment includes attaching a pantyhose waistband 17 to the attachment mechanism 80 and stretching the pantyhose waistband 17 along the edge of the panel 20 to determine a measurement of waistband stretch in relation to the measurement scale 81 along the edge of the panel 20. The waistband stretch measurement is then compared with pre-determined manufacturing parameters.

Although the present invention has been described with reference to particular embodiments, it should be recognized that these embodiments are merely illustrative of the principles of the present invention. Those of ordinary skill in the art will appreciate that the pantyhose inspection device and method of the present invention may be constructed and implemented in other ways and embodiments. Accordingly, the description herein should not be read as limiting the present invention, as other embodiments also fall within the scope of the present invention.

What is claimed is:

1. A pantyhose inspection device comprising:

a substantially flat panel having a central vertical axis;

two spaced apart legs extending upwardly from the panel;

a transverse bar positioned between the two legs; and a center bat extending vertically downward from between the two spaced apart legs along the central vertical axis, the center bar comprising a plurality of center seam measurement indicators;

wherein when a pantyhose garment having a gusset and a center seam is stretched over the legs, the transverse bar, and the panel, the gusset is viewable below the transverse bar for inspection of medial seams for front-to-back alignment and of lateral seams for side-to-side alignment, the center seam is viewable for inspection of alignment with the center bar, and center seam stretch of the pantyhose garment is viewable for inspection in relation to the center bar measurement indicators.

2. The inspection device of claim 1, the panel further comprising a plurality of panty volume indicators, wherein when the pantyhose garment is stretched over the panel, a panty volume of the pantyhose garment is viewable for inspection.

3. The inspection device of claim 1, the legs further comprising a toe length indicator, wherein when the pantyhose garment is stretched over the legs, a toe length of the pantyhose a garment is viewable for inspection.

4. The inspection device of claim 1, the panel further comprising a pantyhose waistband attachment mechanism and a waistband stretch scale, wherein when a pantyhose waistband is attached to the pantyhose waistband attachment mechanism and stretched along the waistband stretch scale, a measurement of the amount of waistband stretch of the pantyhose is determinable.

5. The inspection device of claim 4, wherein the pantyhose waistband attachment mechanism comprises a hook.

6. The inspection device of claim 4, wherein the pantyhose waistband attachment mechanism is located at a bottom of the panel.

7. The inspection device of claim 1, wherein the upwardly extending legs are tapered.

8. The inspection device of claim 7, wherein the upwardly extending legs angle towards the central vertical axis of the panel.

9. The inspection device of claim 1, wherein the upwardly extending legs angle towards the central vertical axis of the panel.

10. The inspection device of claim 1, the panel further comprising a rectangular cut-out located on each side of the central vertical axis in adjacent relationship thereto.

11. The inspection device of claim 1, wherein the panel further comprises rigid material.

12. The inspection device of claim 11, wherein the panel comprises aluminum.

13. The inspection device of claim 11, wherein the panel comprises plastic.

14. The inspection device of claim 1, the panel further comprising a front and a back, wherein the front and the back are identical.

15. The inspection device of claim 1, further comprising a base rotatably attached to the panel.

16. The inspection device of claim 15, wherein the base comprises a means for moving the base and the panel.

17. The inspection device of claim 15, wherein the means for moving the base and the panel comprises casters.

18. A pantyhose inspection device comprising:

a substantially flat panel having a central vertical axis;

two spaced apart legs extending upwardly from the panel;

a transverse bar positioned between the two legs;

a center bar extending vertically downward from between the two spaced apart legs along the central vertical axis, the center bar comprising a plurality of center seam measurement indicators;

a plurality of panty volume indicators spaced apart alone pre-determined zones of panty volume expansion on the panel;

a toe length indicator;

a pantyhose waistband attachment mechanism; and a pantyhose waistband measurement scale, wherein when a pantyhose garment is stretched over the legs, the transverse bar, and the panel, gusset alignment, center seam alignment, panty volume, toe length, and center seam stretch of the pantyhose garment is each viewable for inspection;

wherein the center seam is viewable for inspection of alignment with the center bar, and center seam stretch of the pantyhose garment is viewable for inspection in relation to the center bar measurement indicators; and wherein when a pantyhose waistband is attached to the pantyhose waistband attachment mechanism and stretched along the pantyhose waistband measurement scale, a measurement of waistband stretch of the pantyhose is determinable.

19. The inspection device of claim 18, the panel further comprising a front and a back, wherein the front and the back are identical.

20. The inspection device of claim 18, further comprising a base rotatably attached to the panel.

21. The inspection device of claim 20, wherein the base comprises a means for moving the base and the panel.

22. A pantyhose inspection device comprising:

a substantially flat panel having a top, a bottom, a front, a back, and two sides, the panel symmetrical about a central vertical axis between the two sides;

two legs extending upwardly from the top of the panel and spaced apart beginning at a bifurcation point;

a transverse bar positioned between the two legs, the spaced apart legs and transverse bar defining a triangular crotch area;

a center bar extending vertically downward from the bifurcation point along the central vertical axis to the bottom of the panel, the center bar having a plurality of measurement indicators in a vertical direction; and each side of the panel comprising a cut-out adjacent the center bar in the vertical direction;

wherein when a pantyhose garment having a gusset and a center seam is placed over the legs and the panel, the gusset is viewable for inspection in the triangular crotch area below the transverse bar for inspection of medial seams for front-to-back alignment and of lateral seams for side-to-side alignment, the center seam is viewable for inspection of alignment with the center bar, and center seam stretch is viewable for inspection in relation to the center bar measurement indicators.

23. The inspection device of claim 22, the panel further comprising a plurality of panty volume indicators spaced apart along pre-determined zones of panty volume expansion, wherein when the pantyhose garment is stretched downwardly over the panel, a panty volume of the pantyhose garment is measurable in relation to the zones of panty volume expansion.

24. The inspection device of claim 23, wherein the plurality of panty volume indicators comprises volume indicators along each of the two sides of the panel.

25. The inspection device of claim 24, wherein each of the plurality of panty volume indicators comprises a downwardly arcuate line.

26. The inspection device of claim 22, each of the two legs further comprising at least two spaced apart toe length indicators defining a pre-determined range for acceptable pantyhose toe length, wherein when a leg of the pantyhose garment having a toe length is placed over one of the legs of the panel, the pantyhose garment toe length is measurable in relation to the at least two spaced apart toe length indicators.

27. The inspection device of claim 26, wherein the at least two spaced apart toe length indicators comprise substantially parallel lines.

28. The inspection device of claim 22, the panel further comprising a pantyhose waistband attachment mechanism for releasably attaching a pantyhose waistband and a waistband stretch measurement scale, wherein when a pantyhose waistband is attached to the attachment mechanism, a waistband stretch quantity is measurable in relation to the waistband stretch measurement scale.

29. The inspection device of claim 28, wherein the pantyhose waistband attachment mechanism comprises a hook.

30. The inspection device of claim 28, wherein the pantyhose waistband attachment mechanism is located at the bottom of the panel.

31. The inspection device of claim 22, wherein the upwardly extending legs are tapered.

32. The inspection device of claim 22, wherein the upwardly extending legs angle towards the central vertical axis of the panel.

33. The inspection device of claim 22, wherein the transverse bar comprises a position so proximate the bifurcation point.

34. The inspection device of claim 22, wherein the cut-out in each side of the panel comprises a rectangular shape.

35. The inspection device of claim 22, wherein the panel further comprises rigid material.

36. The inspection device of claim 35, wherein the panel comprises aluminum.

37. The inspection device of claim 35, wherein the panel comprises plastic.

38. The inspection device of claim 22, wherein the front and the back of the inspection device are identical.

39. The inspection device of claim 22, wherein the pantyhose inspection device further comprises a base.

40. The inspection device of claim 39, wherein the base is attached to the bottom of the panel.

41. The inspection device of claim 39, wherein the panel is rotatable in relation to the base.

42. The inspection device of claim 39, wherein the base comprises a means for moving the base and the panel.

43. The inspection device of claim 42, wherein the means for moving the base and the panel comprises casters.

44. The inspection device of claim 22, wherein the panel further comprises a non-stick it coating.

45. A pantyhose inspection device comprising:

a substantially flat panel having a top, a bottom, a front, a back, and two sides, the panel symmetrical about a central vertical axis between the two sides;

two legs extending upwardly from the top of the panel and spaced apart beginning at a bifurcation point, each leg tapered distally from the bifurcation point and angled towards the central vertical axis of the panel;

a transverse bar positioned between the two legs, the spaced apart legs and transverse bar defining a triangular crotch area;

a center bar extending vertically downward from the bifurcation point along the central vertical axis to the bottom of the panel, the center bar having a plurality of measurement indicators in a vertical direction;

each side of the panel comprising a rectangular-shaped cut-out adjacent the center bar in the vertical direction;

a plurality of panty volume indicators spaced apart along pre-determined zones of panty volume expansion on each of the two sides of the panel;

at least two spaced apart toe length indicators located on each of the two legs defining a pre-determined range for acceptable pantyhose toe length; and the panel further comprising a pantyhose waistband attachment mechanism and a waistband stretch measurement scale, wherein when a pantyhose garment having a gusset, a center seam, a panty volume, and a toe length is placed over the legs and the panel, the gusset is viewable for inspection below the transverse bar in the triangular crotch area for inspection of medial seams for front-to-back alignment and of lateral seams for side-to-side alignment, and the center seam is viewable for inspection of alignment relative to the center bar and center seam stretch is viewable for inspection in relation to the center bar measurement indicators, wherein the panty volume is measurable in relation to the zones of panty volume expansion, wherein the toe length is measurable in relation to the at least two spaced apart toe length indicators, and wherein when a pantyhose waistband is attached to the pantyhose waistband attachment mechanism and stretched along the waistband stretch measurement scale, a waistband stretch quantity is measurable in relation to the waistband stretch measurement scale.

46. The inspection device of claim 45, wherein the front and the back of the inspection device are identical.

47. The inspection device of claim 45, further comprising a movable base attached to the bottom of the panel, the panel rotatable in relation to the base.

48. A method for inspecting a pantyhose garment having a gusset, a center seam, a panty volume, a toe length, and a waistband with a single inspection device in a manufacturing production line, comprising:

inspecting alignment of the gusset;

inspecting alignment of the center seam;

determining a measurement of center seam stretch;

inspecting the panty volume;

inspecting the toe length; and determining a measurement of waistband stretch.

49. A method for inspecting a pantyhose garment in a manufacturing production line, comprising:

providing a pantyhose inspection device comprising a substantially flat panel having a central vertical axis, two spaced apart legs, and a transverse bar positioned between the two legs, the panel further comprising a center bar extending vertically downward from between the two spaced apart lees along the central vertical axis, the center bar comprising a plurality of center seam measurement indicators, a plurality of panty volume indicators spaced apart along pre-determined zones of panty volume expansion on the panel, a toe seam position indicator, a pantyhose waistband attachment mechanism, and a pantyhose waistband measurement scale;

stretching a pantyhose garment having a gusset, a center seam, a panty volume, a toe seam, and a waistband over the legs, the transverse bar, and the panel;

inspecting front-to-back alignment and side-to-side alignment of the gusset below the transverse bar;

inspecting alignment of the center seam in relation to the center bar along the central vertical axis;

determining a measurement of center seam stretch in relation to the plurality of center seam measurement indicators;

inspecting the panty volume in relation to the plurality of panty volume indicators;

inspecting a position of the toe seam in relation to the toe seam position indicator;

attaching the waistband to the pantyhose waistband attachment mechanism;

stretching the waistband along the pantyhose waistband measurement scale; and determining a measurement of waistband stretch in relation to the pantyhose waistband measurement scale.

50. The method of claim 49, the panel fiurther comprising a front and a back, wherein the front and the back are identical.

51. The method of claim 49, the pantyhose inspection device further comprising a base rotatably attached to the panel.

52. The method of claim 51, wherein the base comprises a means for moving the base and the panel.

53. A method for inspecting a pantyhose garment comprising:

providing a pantyhose inspection device comprising a substantially flat panel having a top, a bottom, a front, a back, and two sides, the panel symmetrical about a central vertical axis between the two sides, two legs extending upwardly from the top of the panel and spaced apart beginning at a bifurcation point, a transverse bar positioned between the two legs, the spaced apart legs and transverse bar defining a triangular crotch area, the legs tapered distally from the transverse bar and angled towards the central vertical axis of the panel, a center bar extending vertically downward along the central vertical axis from the bifurcation point to the bottom of the panel, the center bar having a plurality of measurement indicators in a vertical direction, and each side of the panel comprising a rectangular-shaped cut-out adjacent the center bar in the vertical direction;

stretching a pantyhose garment having a gusset, a center seam, and a waistband over the legs and the panel;

inspecting front-to-back alignment and side-to-side alignment of the gusset below the transverse bar through the triangular crotch area;

inspecting alignment of the center seam in relation to the center bar;

determining a measurement of center seam stretch in relation to the center bar measurement indicators; and comparing the center seam stretch measurement with pre-determined manufacturing parameters.

54. The method of claim 53, the panel further comprising a plurality of panty volume indicators spaced apart along pre-determined zones of panty volume expansion, and each of the two sides further comprising an edge, the method further comprising:

stretching the pantyhose garment waistband downwardly along each edge; and comparing the location of the stretched waistband in relation to the pre-determined zones of panty volume expansion.

55. The method of claim 53, each of the two legs further comprising at least two spaced apart toe length indicators defining a pre-determined range for acceptable pantyhose toe length, the method further comprising:

stretching a pantyhose garment having a toe length over one of the legs of the panel; and comparing the pantyhose garment toe length in relation to the at least two spaced apart toe length indicators.

56. The method of claim 53, each of the two sides further comprising an edge and the panel further comprising a pantyhose waistband attachment mechanism located proximate at least one of the edges for releasably attaching a pantyhose waistband and a waistband measurement scale along at least one of the edges proximate the pantyhose waistband attachment mechanism, the method further comprising:

attaching a pantyhose waistband to the attachment mechanism;

stretching the pantyhose waistband along the edge of the panel;

determining a measurement of waistband stretch in relation to the measurement scale along the edge of the panel; and comparing the waistband stretch measurement with pre-determined manufacturing parameters.

57. The method of claim 56, wherein the pantyhose waistband attachment mechanism comprises a hook located at the bottom of the panel.

58. A method for inspecting a pantyhose garment comprising:

providing a pantyhose inspection device comprising a substantially flat panel having a top, a bottom, a front, a back, and two sides each having an edge, the panel symmetrical about a central vertical axis between the two sides, two legs extending upwardly from the top of the panel and spaced apart beginning at a bifurcation point, a transverse bar positioned between the two legs, the spaced apart legs and transverse bar defining a triangular crotch area, the legs tapered distally from the transverse bar and angled towards the central vertical axis of the panel, a center bar extending vertically downward along the central vertical axis from the bifurcation point to the bottom of the panel, the center bar having a plurality of measurement indicators in a vertical direction, and each side of the panel comprising a rectangular-shaped cut-out adjacent the center bar in the vertical direction, a plurality of panty volume indicators spaced apart along pre-determined zones of panty volume expansion on the panel, each of the two legs further comprising at least two spaced apart toe length indicators defining a pre-determined range for acceptable pantyhose toe length, a hook for releasably attaching a pantyhose waistband, and a waistband stretch measurement scale along at least one of the edges;

stretching a pantyhose garment having a gusset, a center seam, a panty volume, a toe length, and a waistband over the legs, the transverse bar, and the panel;

inspecting front-to-back alignment and side-to-side alignment of the gusset below the transverse bar through the triangular crotch area;

inspecting alignment of the center scam in relation to the center bar;

determining a measurement of center seam stretch in relation to the center bar measurement indicators;

comparing the center seam stretch measurement with pre-determined manufacturing parameters;

stretching the pantyhose garment waistband downwardly along each edge of the panel;

comparing the location of the stretched waistband in relation to the pre-determined zones of panty volume expansion;

comparing the position of the pantyhose garment toe length in relation to the at least two spaced apart toe length indicators;

attaching a pantyhose waistband to the hook;

stretching the waistband along the edge of the panel;

determining a measurement of waistband stretch in relation to the measurement scale along the edge of the panel; and comparing the waistband stretch measurement with pre-determined manufacturing parameters.

59. The method of claim 58, wherein the front and the back of the panel are identical.

60. The method of claim 58, the pantyhose inspection device further comprising a base rotatably attached to the panel.

61. The method of claim 60, wherein the base comprises a means for moving the base and the panel.

* * * * *